US006883223B2

(12) United States Patent
Edwards

(10) Patent No.: US 6,883,223 B2
(45) Date of Patent: Apr. 26, 2005

(54) CONTROLLED FLOW OF DISPLACED MATERIAL IN SELF-PIERCE FASTENING

(76) Inventor: Kenneth Edwards, Ariel Industries plc, Ariel Works, Temple Road, Leicester LE5 4JG (GB)

( * ) Notice: Subject to any disclaimer, the term of this patent is extended or adjusted under 35 U.S.C. 154(b) by 86 days.

(21) Appl. No.: 10/312,664

(22) PCT Filed: Jun. 29, 2001

(86) PCT No.: PCT/GB01/02916

§ 371 (c)(1),
(2), (4) Date: Dec. 27, 2002

(87) PCT Pub. No.: WO02/02259

PCT Pub. Date: Jan. 10, 2002

(65) Prior Publication Data

US 2004/0010903 A1 Jan. 22, 2004

(30) Foreign Application Priority Data

Jun. 30, 2000 (GB) ..... 0015918
Aug. 15, 2000 (GB) ..... 0019941

(51) Int. Cl.[7] ..... B21J 15/02
(52) U.S. Cl. ..... 29/525.06; 29/428; 29/525.01

(58) Field of Search ..... 29/525.06, 525.01, 29/525.04, 525.07, 525.08, 525.09, 428, 798, 524.1; 227/62; 411/179

(56) References Cited

U.S. PATENT DOCUMENTS 4,389,766 A * 6/1983 Capuano ..... 29/432.2
4,610,072 A * 9/1986 Muller ..... 29/512
4,711,021 A 12/1987 Muller

FOREIGN PATENT DOCUMENTS

GB 2314794 1/1998

* cited by examiner

*Primary Examiner*—John C. Hong
(74) *Attorney, Agent, or Firm*—Ira S. Dorman

(57) ABSTRACT

A self-piercing tubular fastener (13) is applied to a workpiece (9, 11) by means of a setting die (1) which is formed with a radially inner cavity (17) and a radially outer cavity (5) surrounding the radially inner cavity such that a first part of the material displaced as the fastener (13) penetrates the workpiece flows into the radially inner cavity in the setting die whilst a second part of the displaced material flows into the radially outer cavity.

20 Claims, 2 Drawing Sheets

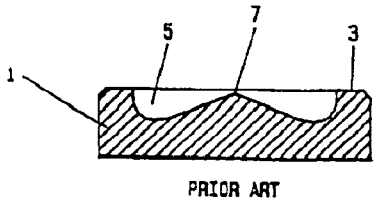
FIG 1.
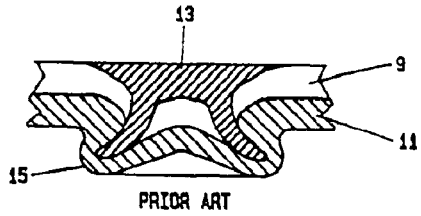
FIG 1A.
FIG 2.
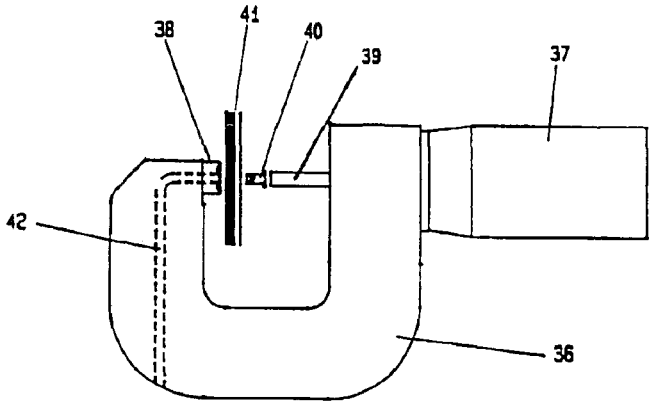
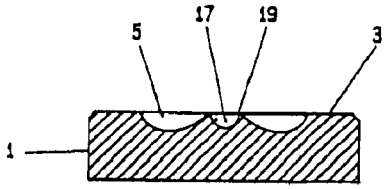
FIG 3.
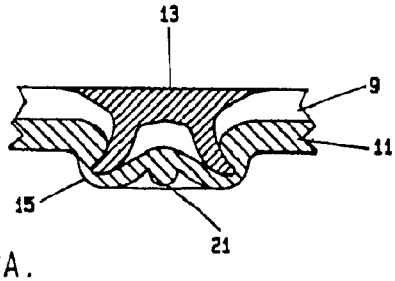
FIG 3A.
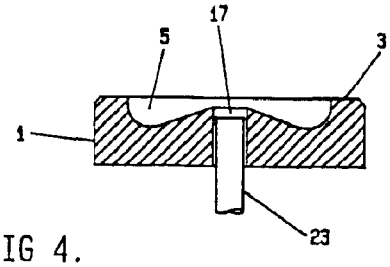
FIG 4.
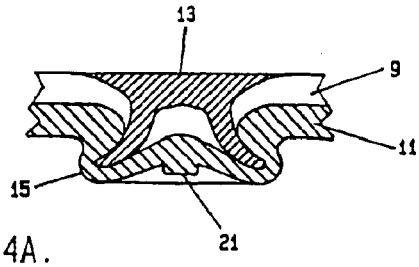
FIG 4A.
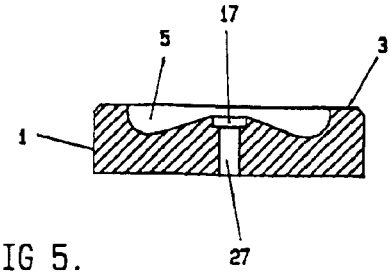
FIG 5.
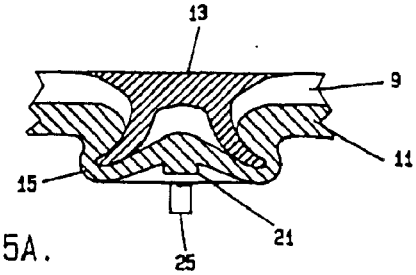
FIG 5A.

CONTROLLED FLOW OF DISPLACED MATERIAL IN SELF-PIERCE FASTENING

This invention relates to self-pierce fastening and more particularly to a method and apparatus for fastening of the kind in which a self-piercing semi-tubular fastener is inserted into a workpiece from one side thereof with or without full penetration and at least part of the material displaced by the insertion of the fastener flows into a central cavity within a setting die mounted at the other side of the workpiece.

U.S. Pat. No. 4,711,021 discloses a method of attaching a female element to a panel, the female element having a bore therethrough and a generally annular piercing and riveting portion. The panel is supported on a die member having an annular die cavity and a central die bore and the annular piercing and riveting portion of the female element is biased against the panel. A punch having a rounded end surface is driven through the bore of the female element thereby doming a panel portion into a central die bore. The annular piercing and riveting portion is driven against the panel and pierces the domed panel portion from the panel and forms a pierced panel opening and a panel slug, the punch driving the slug into the central die bore. Finally, the piercing and riveting portion is deformed to form a mechanical interlock between the piercing and riveting portion of the female element and the panel.

GB-A-2 314 794 discloses a method of self-pierce riveting in which a self-piercing rivet is inserted into a workpiece consisting of at least two layers of overlapping material such that the end of the rivet is deformed during the riveting process and remains encased in the material furthest from the point of impact of the rivet. During the riveting process the sides of the rivet are constrained against radially outward deformation in the region where the rivet enters the workpiece by a die. A punch forces the rivet into the layers which are supported on an anvil.

According to current practice self-piercing fasteners, such as rivets, are applied by riveting machines such as described in U.S. Pat. No. 6,073,525. Each machine contains a plunger, a nose assembly, and a setting die. The nose assembly houses a rivet guidance tube and a clamping surface. The setting die has an annular clamping surface surrounding a semi-toroidal cavity with a raised central projection. The central projection serves two purposes: firstly it acts as a support for the workpiece(s) (for example, two or more layers of sheet material) during rivet penetration; and secondly it causes the displaced material and the rivet tube to flow outwardly into the semi-toroidal cavity. In operation the plunger drives a self-piercing rivet along the rivet guidance tube to bring it into contact with workpiece(s) clamped between the clamping surfaces of the nose assembly and the setting die. Further travel of the plunger drives the rivet into engagement with the workpiece(s), displacing material from the workpiece(s) into the semi-toroidal cavity within the setting die, thereby creating a button of displaced material under the, or the lower, workpiece.

This form of self-pierce riveting has a number of limitations and disadvantages. For instance if the workpieces to be fastened are too thick or too resistant to metal displacement, the forces required for rivet penetration may be greater than those which the rivet can withstand without collapsing. If the lower workpiece is too thin, it may not be possible to achieve an effective join because of the difficulty in obtaining sufficient width of rivet roll without breaking through the lower workpiece. If the workpieces consist of materials, such as plastics materials, which cannot generate sufficient internal pressure within the rivet to cause it to roll outwardly, it will not be possible to generate an adequate outward roll of the rivet tube within the lower workpiece to secure the workpieces.

It is an object of the present invention to overcome or mitigate the above-described limitations and disadvantages.

According to the present invention there is provided a method of applying a self-piercing fastener to a workpiece comprising the steps of:

(a) locating a punch in alignment with a setting die, the setting die being formed with a radially inner cavity and a radially outer cavity surrounding the radially inner cavity;

(b) positioning the workpiece between the punch and the setting die;

(c) positioning a self-piercing fastener between the workpiece and the punch; and (d) advancing the punch to drive the fastener into piercing engagement with the workpiece thereby displacing material from the workpiece into the setting die wherein the fastener comprises a semi-tubular fastener having a head and a shank, the shank having a tubular portion engaging the workpiece, and wherein as the fastener penetrates the workpiece the fastener displaces a slug of material substantially equal to the diameter of the shank of the fastener, a first part of the displaced material flowing into the radially inner cavity in the setting die and a second part of the displaced material flowing into the radially outer cavity of the setting die.

Thus the present invention provides a novel method of controlling the flow of displaced material during a fastening operation. This is achieved by replacing the peak and at least part of the core of the raised central projection of a conventional setting die by various configurations of central, or radially inner, cavities into which displaced material can flow. A die for use according to the current invention has an inner cavity which provides space into which the material displaced during the early stages of fastener penetration can flow under lower displacement forces than would be required if the peak of the central projection were in place, and an outer cavity which provides space into which the remainder of the displaced material can flow. As the outer cavity has to hold only a part of the displaced material, it can be smaller than the cavity of a conventional die and consequently can fill under lower displacement forces than those required for a conventional die.

In an embodiment of the invention the semi-tubular fastener, such as a rivet, is driven through a first (e.g., upper) workpiece into non-piercing engagement with a second (e.g., lower) workpiece. That is, the fastener rolls within the (second) workpiece without full penetration.

In such an embodiment, the inner cavity will normally be a round hole axially in line with the fastener and the plunger of the fastening machine. This configuration allows displaced material to flow readily into the inner cavity in the early stages of fastener penetration. When the inner cavity is full, the displaced material within it effectively acts as a central projection causing the remaining displaced material to flow outwardly into the outer cavity. The volume of displaced material which flows into the inner cavity can be precisely regulated to a desired amount by controlling the diameter and depth (i.e. volume) of the cavity. The central hole reduces the force required for initial material displacement thereby reducing the risk of fastener tube collapse at a time when it has no side support. It also reduces the volume of displaced material flowing into the outer button thereby minimising the risk of button cracking.

Thus, the inner cavity of the setting die may comprise a blind hole of limited depth so as to allow a predetermined volume of displaced material to flow into the blind hole during fastener penetration of the workpiece, the displaced material remaining integral with the workpiece when the workpiece is removed from the setting die.

Alternatively, the inner cavity may comprise a through-hole. In this case, the inner cavity of the setting die may contain a movable member which allows a limited volume of displaced material to enter the hole in the cavity in the early stages of fastener penetration but applies force later in the fastening cycle to push at least a portion of the material in the hole back into the button of displaced material. Compaction of the button of displaced material in this way improves the strength of the join.

Where it is desirable to separate at least a portion of the first part of the displaced material from the (second) workpiece, the inner cavity may be a multi-diameter through-hole which allows at least a portion of the first part of the displaced material to be separated from the workpiece and to remain in the hole until pushed to an exit point by further displaced material from successive fastener applications. A desired amount of displaced material may remain in a lower part of the cavity when the workpiece is removed. The part of the through-hole adjacent the workpiece may be of greatest diameter. However, it should be noted that a multi-diameter throughhole is not essential and that a single diameter throughhole can be employed with a portion of the first part of the displaced material remaining integral with the button and a portion of it breaking off and remaining within the inner cavity of the die. Separation of at least a portion of the first part of the displaced material from the (second) workpiece enables the volume of the button to be reduced. The volume of displaced material which flows into the through-hole is dependent upon the diameter(s) of the through-hole and the frictional drag of the side walls as the displaced material flows down the hole.

As a further option, the through-hole may taper. The taper may be such that the cross-sectional area of the throughhole decreases or increases with increasing distance from the workpiece.

In an alternative embodiment of the invention the fastener is driven through a first (e.g., upper) workpiece and a second (e.g., lower) workpiece with full piercing engagement. Thus, the fastener pierces completely through the workpiece(s) to bring the tubular end of the fastener into contact with the setting die, the setting die causing the fastener to roll outwardly into a toroidal or part-toroidal form to secure the workpiece(s) between the head of the fastener and the roll.

In either embodiment of the invention, the tubular end of the fastener may be rolled outwardly within a part-toroidal outer cavity surrounding the inner cavity of the setting die, the inner cavity comprising a through-hole of a diameter which allows a desired volume of displaced material to flow into the hole during fastener penetration of the workpiece. In this case, slugs of displaced material from each fastener application may pass down the through-hole, with each slug being pushed by successive slugs until it drops free.

Again, the through-hole may taper, the taper being such that the cross-sectional area of the through-hole decreases or increases with increasing distance from the workpiece.

The displaced material is automatically divided into two parts. The fastener displaces a slug of material with a diameter approximately equal to the diameter of the shank of the fastener. The centre (first part) of this slug passes into the inner cavity of the die, the diameter of which is less than the diameter of the shank of the fastener, leaving an outer tube (second part) of displaced material which flows into the outer cavity. If the volume of the outer tube is small, it can be contained within the roll of the fastener. However, if the volume of the tube is too great to be contained within the roll of the fastener, the excess material will form a sealing ring immediately around the roll of the fastener.

Ideally the fastener will be dimensioned so that, when the head of the fastener is brought firmly into contact with the (first) workpiece, the solid section of the shank of the fastener is brought into contact with the upper part of the inner cavity and a large part of the displaced material is forced into the through-hole in the setting die. This arrangement allows the tube of the fastener to have free access to the surface of the setting die so that it can readily be rolled into a toroidal or part-toroidal form or, if the die has radial shearing lines, into a star-set form, and allows the remainder of the displaced material to be carried through to form a sealing ring immediately adjacent to the roll of the fastener.

This embodiment is particularly useful when fastening sheet materials, such as plastics materials, which cannot generate sufficient internal pressure within the fastener to cause it to roll outwardly within the (second) sheet, and hence need to be fastened by the fastener passing through the materials, allowing the end of the tube of the fastener to contact a setting die and roll outwardly into engagement with the lower surface of the material.

This embodiment is also useful in fastening low strength materials of low compressibility because with such materials the slug quickly fills the tubular portion of the fastener and prevents it cutting cleanly through the lower sections of the workpiece to allow a full penetration join. In practice, if the tube is lengthened to accommodate the slug, it is prone to collapse when subjected to the forces required to generate a wide roll. A wide roll is essential when fastening materials of low strength. In fact it is highly desirable to have a full roll as described in DE-A-199 22 246 because such a roll generates a spring-back effect which provides higher residual compression of the workpiece(s) and hence adds to the security of the join.

In the present invention the fastener should not enter the inner cavity of the setting die. Hence the maximum diameter of the inner cavity should be less than the inner diameter of the tube of the fastener when the fastener approaches the setting die. The point here is that the internal diameter of the fastener increases as the fastener rolls outwardly and may be further increased by being formed with an internal taper at the mouth of the tube.

The inner cavity may lie within an inner wall of an outer cavity. The outer cavity can have any profile which assists the outward flow of both the displaced material and the fastener tube, but will normally have a part-toroidal profile. The outer cavity may be surrounded by a clamping surface. The inner wall of the outer cavity may be of any desired height relative to a clamping surface thereof. Hence the inner wall may perform a workpiece support function. The top surface of the inner wall may be in the form of a cutting edge. Alternatively, the inner wall may terminate in a land of any desired width.

The inner cavity may house a plunger which is actuated by the fastening machine to increase or decrease the capacity of the inner cavity as required. An arm of the fastening machine supporting the setting die may incorporate a passage down which the separated displaced material may flow to a convenient exit point.

In all these embodiments the inner cavity will normally be axially aligned with the punch and advancing fastener, but this invention is not restricted to axially aligned cavities. The cavity may be offset and may depart from a straight line through-hole, for instance to discharge slugs of material at some convenient exit point.

The method according to the present invention may be used to secure an additional member on at least one side of the workpieces. This is achieved by positioning an additional member on at least one side of the workpieces, the fastener passing through a pre-formed aperture in the additional member.

For a better understanding of the present invention and to show more clearly how it may be carried into effect reference will now be made, by way of example, to the accompanying drawings in which:

FIG. 1 is a sectional side elevation of a setting die as used in current practice;

FIG. 1A is a cross-sectional view of a rivet join made by self-pierce riveting according to current practice;

FIG. 2 is a schematic side elevational view of a riveting machine according to the present invention for applying self-pierce rivets;

FIG. 3 is a sectional side elevation of a setting die for use according to the present invention with an inner cavity surrounded by an outer cavity;

FIG. 3A is a cross-sectional view of a rivet join made with the setting die shown in FIG. 3;

FIG. 4 is a sectional side elevation of a setting die for use according to the present invention wherein the inner cavity is a through-hole which houses a plunger;

FIG. 4A is a cross-sectional view of a rivet join made with the setting die shown in FIG. 4;

FIG. 5 is a sectional side elevation of a setting die for use according to the present invention wherein the inner cavity is a two-diameter through-hole;

FIG. 5A is a cross-sectional view of a rivet join made with the setting die shown in FIG. 5 with a slug of displaced material detached from the button;

In the drawings the same references are used to denote the same or similar parts.

Figure 6:
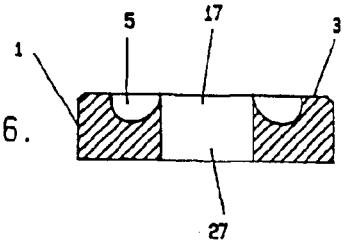
FIG. 6 is a sectional side elevation of a setting die for use according to the present invention wherein the inner cavity is a through-hole and the die is adapted for full penetration of the workpiece(s)

The known setting die 1 shown in FIG. 1 comprises an annular clamping surface 3 surrounding a semi-toroidal cavity 5 having a raised central projection 7. FIG. 1A shows the results of using such a known setting die 1 to join two workpieces 9, 11 with a self-pierce rivet 13. As can be seen, the rivet has been driven through the upper workpiece 9 into non-piercing engagement with the lower workpiece 11 and a button 15 of displaced material has formed beneath the lower workpiece 11.

The riveting (fastening) machine shown schematically in FIG. 2 comprises a C-frame 36 with a hydraulic cylinder 37 mounted on one arm and a setting die 38 mounted on the other arm. The hydraulic cylinder 37 drives a plunger 39 which in turn drives a rivet (fastener) 40 into workpieces 41. Material displaced as the rivet penetrates the workpieces flows into die 38. As will be described hereinafter, part of the displaced material which flows into an inner cavity passes through a passage 42 in the lower arm of the C-frame 36 to a collection point (not shown).

In the setting die 1 for use according to the present invention as shown in FIG. 3, the raised central projection of the setting die of FIG. 1 is replaced by a central cavity 17 such that the outer semi-toroidal cavity 5 and the central cavity 17 are separated by a circular upstanding wall 19. Thus central cavity 17 of FIG. 3 comprises a radially inner cavity in the form of a blind hole of limited depth while the semi-toroidal cavity 5 is in the form of a radially outer cavity surrounding the inner cavity. FIG. 3A shows the results of using the setting die of FIG. 3. As can be seen, whilst most (a second part) of the displaced material has flowed into the semi-toroidal cavity 5 and given rise to the button 15, a predetermined volume (a first part) of the displaced material has flowed into the central cavity 17 giving rise to a central protrusion 21 formed integrally on the button 15. Thus the volume of the semi-toroidal cavity 5 can be reduced by an amount corresponding to the volume of the central protrusion 21.

In the setting die 1 shown in FIG. 4, the central cavity 17 is in the form of a through-hole which houses a movable member in the form of a plunger 23 which can be moved upwardly (as shown in the figure). Thus, the plunger 23 allows a limited volume of displaced material to enter the through-hole 17 in the early stages of rivet penetration, but can be moved upwardly later in the riveting cycle to push at least part of the displaced material in the hole back into the button 15. FIG. 4A shows the results of using the setting die of FIG. 4. As can be seen, there remains a small protrusion 21 formed integrally on the button 15.

In the setting die 1 shown in FIG. 5, the central cavity 17 is in the form of a through-hole having multiple diameters (two diameters as illustrated) with the part of greatest diameter being located to be adjacent the workpiece 11. In use of the setting die of FIG. 5, a slug 25 of displaced material in the part of the throughhole of smallest diameter becomes separated from the workpiece 11 and remains within the through-hole when the joined workpieces 9, 11 are removed. Successive rivet applications give rise to further slugs 25 of separated displaced material which push earlier formed slugs 25 along the through-hole 17 to an exit point 27. FIG. 5A shows the results of using the setting die of FIG. 5. As can be seen, there remains a small protrusion 21 formed integrally on the button 15. It should be noted that multiple diameters are not essential and that a throughhole of constant diameter could be similarly employed.

Figure 6A:
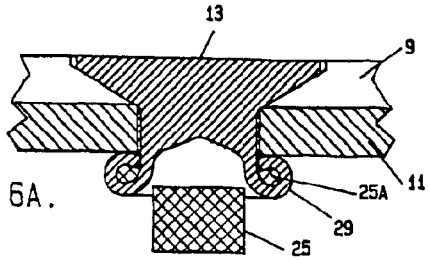
FIGS. 6A and 6B are cross-sectional views of rivet joins made with the setting die as shown in FIG. 6 wherein the rivet has rolled beneath a lower workpiece and shows the material displaced by the rivet entry dropping free from the workpiece.
Figure 6B:
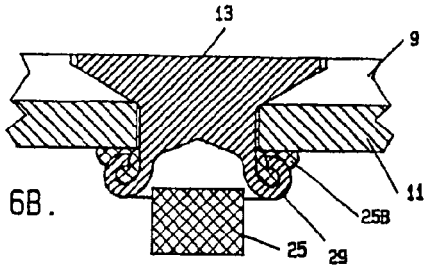

In the setting die 1 shown in FIG. 6, the central cavity 17 is in the form of a through-hole of constant, relatively large, diameter. FIG. 6A shows the results of using such a setting die 1 to join two workpieces 9, 11 with a self-pierce rivet 13 in which the rivet has been driven entirely through the upper and lower workpieces, that is in full piercing engagement. As can be seen from FIG. 6A, there is no button and the tubular end 29 of the rivet has rolled outwardly within the part-toroidal outer cavity 5. The central cavity 17 allows a slug 25 formed by a first part of the displaced material to flow into the central cavity 17 as the rivet penetrates the workpieces 9, 11 and to drop freely from the lower face of the setting die 1, while a second part 25A of the displaced material is contained with the roll of the rivet. FIG. 6B shows the situation where the volume of an outer tube of displaced material is greater than can be accommodated within the roll of the rivet and the excess has formed a sealing ring 25B between the roll of the rivet and the workpiece.

Figure 7:
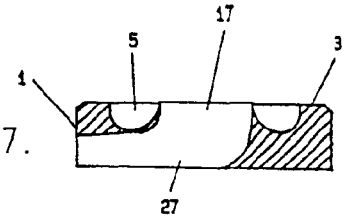
FIG. 7 is a sectional side elevation of a setting die for use according to the present invention wherein the inner cavity departs from a straight line through-hole to discharge slugs of displaced material at some convenient exit point.
Figure 7A:
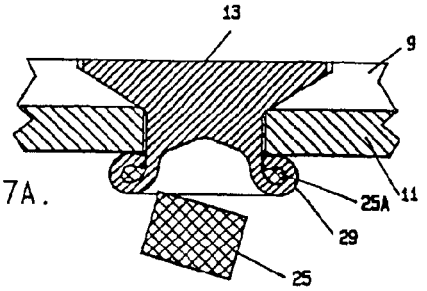
FIG. 7A is a cross-sectional view of a rivet join made by the setting die shown in FIG. 6 wherein the rivet has rolled beneath the lower workpiece and shows the material displaced by the rivet entry being discharged to an exit point on the side of the die.

The setting die 1 shown in FIG. 7 differs from that shown in FIG. 6 in that the through-hole 17 departs from a straight line in order to discharge the slugs 25 of displaced material at a convenient exit point 27. FIG. 7A is similar to FIG. 6A except that it shows the slug 25 being displaced laterally as it is separated from the workpieces 9, 11.

Figure 8:
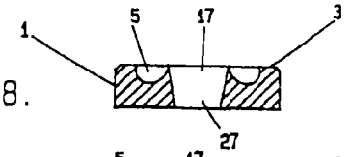
FIG. 8 is a sectional side elevation of a setting die for use according to the present invention wherein the inner cavity is a tapered through-hole.

In the setting die 1 shown in FIG. 8, the central cavity 17 is in the form of a through-hole of tapering configuration. That is, the cross-sectional area of the through-hole decreases with increasing distance from the workpiece 11. However, it should be noted the taper may alternatively be such that the cross-sectional area of the through-hole increases with increasing distance from the workpiece 11.

Figure 9:
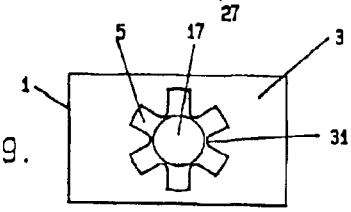
FIG. 9 is a plan view of a setting die having radial shearing lines and a central through-hole.
Figure 9A:
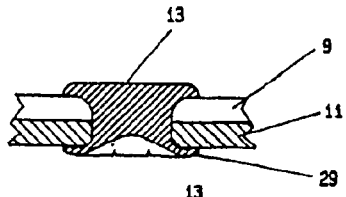
FIG. 9A shows a rivet applied with the setting die of FIG. 9 with full penetration of the workpieces.

In the setting die 1 shown in FIG. 9, the radially outer cavity 5 is formed with radial shearing lines 31 which cause a rivet 13 to set in the form of a star corresponding to the shape of the radially outer cavity 5. As can be seen from FIG. 9A, there is no button and the tubular end 29 of the rivet has been rolled outwardly into the form of a star. Although not shown in the drawings, the central cavity 17 allows a slug of displaced material to flow into the central cavity as the rivet penetrates the workpieces 9, 11 and to drop freely from the lower face of the setting die 1.

Figure 10:
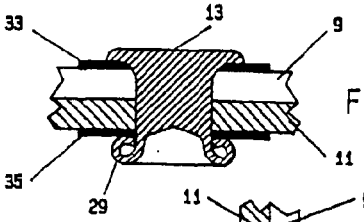
FIGS. 10 to 13 show schematically how riveting with full penetration of the workpieces can be used to secure strengthening or fixing plates to the workpieces.
Figure 11:
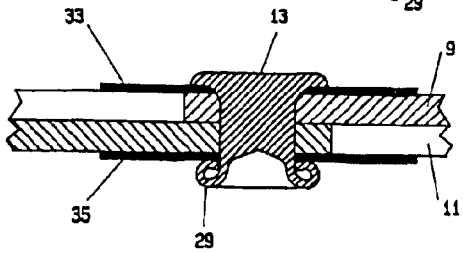
Figure 12:
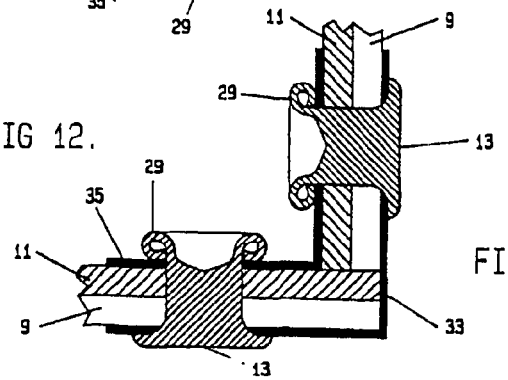

FIGS. 10 to 12 show how riveting with full penetration of the workpieces 9, 11, for example using a setting die 1 as shown in FIG. 7, can be used to secure additional plates 33, 35 between the rivet 13 and the workpieces 9, 11. The additional plates 33, 35 may be in the form of pre-drilled or pre-pierced strengthening or fixing plates, for example. The additional plates may be positioned between the head of the rivet 13 and one of the workpieces and between the outwardly rolled tubular end 29 of the rivet 13 and the other of the workpieces. As shown in FIG. 10, the workpieces 9, 11 may be effectively co-extensive within the region shown in the figure or alternatively, as shown in FIG. 11, the workpieces need not be co-extensive. As shown in FIG. 12, the additional plates may be used to form workpieces into more complex configurations.

Figure 13:
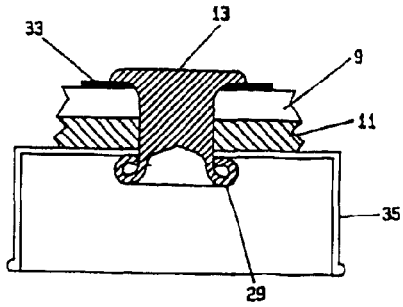

FIG. 13 shows that the additional plates 33, 35 need not be planar and one or both of the additional plates may be in the form of a component which can be used for ancillary purposes, such as fuse boxes, clips for wiring harnesses and the like.

It should be noted displaced material has been omitted from FIGS. 10 to 13 for clarity.

The present invention provides a number of benefits, such as:

1. It reduces the forces generated by fastener penetration and thereby allows self-pierce fastening to be used for fastening thicker and tougher workpieces.
2. It reduces the volume of displaced material forming the outer button on the underside of the (lower) workpiece and hence reduces the distance the displaced material has to travel to fill the outer button. This is important when the requirement is to use self-pierce fastening for sheet material of low ductility which cannot flow far without cracking.
3. It allows unwanted displaced material to be removed from the join.
4. It allows compaction of the displaced material at the end of the fastener insertion stage.
5. It allows the fastener to continue piercing even when the tube is completely filled with displaced material. The point here is that in a setting die without a cavity the displaced material can shroud the cutting edge of the fastener, but when there is a cavity the displaced material can be pushed forward into the cavity thereby leaving the cutting edge free to perform its normal piercing action.

What is claimed is:

1. A method of applying a self-piercing fastener to a workpiece comprising the steps of;

(a) locating a punch in alignment with a setting die, the setting die being formed with a radially inner cavity and a radially outer cavity surrounding the radially inner cavity;

(b) positioning the workpiece between the punch and the setting die;

(c) positioning a self-piercing fastener between the workpiece and the punch; and (d) advancing the punch to drive the fastener into piercing engagement with the workpiece, the fastener thereby displacing material from the workpiece into the setting die wherein the fastener is a semi-tubular fastener having a head and a shank, the shank having a tubular portion engaging the workpiece and the head closing one end of the shank, and wherein, as the fastener penetrates the workpiece the fastener displaces a slug of material with a diameter substantially equal to the diameter of the shank of the fastener, a first part of the displaced material flowing into the radially inner cavity in the setting die and a second part of the displaced material flowing into the radially outer cavity of the setting die.

2. A method according to claim 1, wherein the fastener (13) is driven through a first workpiece (9) into engagement with a second workpiece (11) in a manner whereby the fastener does not penetrate wholly through the second workpiece.

3. A method according to claim 1 wherein the inner cavity (17) of the setting die (1) comprises a blind hole of limited depth so as to allow a predetermined volume of displaced material to flow into the blind hole during fastener penetration of the workpiece (9, 11), the displaced material remaining integral with the workpiece when the workpiece is removed from the setting die.

4. A method according to claim 1 wherein the inner cavity (17) of the selling die (1) comprises a through-hole.

5. A method according to claim 4, wherein the inner cavity (17) of the setting die (1) contains a movable member (23) which allows a limited volume of displaced material to enter the hole in the early stages of fastener penetration but applies force later in the fastening cycle to push at least a portion of the material in the hole back into a button (15) of displaced material which remains integral with the workplace.

6. A method according to claim 4, wherein the inner cavity (17) of the setting die (1) comprises a multi-diameter through-hole which allows some part of the displaced material to be separated from the workpiece and to remain in the hole until pushed to an exit point (27) by further displaced material from successive fastener applications.

7. A method according to claim 6, wherein the part of the through-hole (17) adjacent the workpiece (9, 11) is of greatest diameter.

8. A method according to claim 4, wherein the through-hole (17) tapers.

9. A method according to claim 8, wherein the through-hole (17) tapers such that the cross-sectional area of the through-hole decreases with increasing distance from the workpiece.

10. A method according to claim 8, wherein the through-hole (17) tapers such that the cross-sectional area of the through-hole increases with increasing distance from the workpiece.

11. A method according to claim 1, wherein the fastener (13) is driven through a first workpiece (9) and a second workpiece (11) with full piercing engagement.

12. A method according to claim 11, wherein an end of the tubular portion (29) of the fastener (13) is rolled outwardly within a part-toroidal outer cavity (5) surrounding the inner cavity (17) of the setting die (1), the inner cavity comprising a through-hole of a diameter which allows a desired volume of displaced material to flow into the hole during fastener penetration of the workpiece (9, 11).

13. A method according to claim 12, wherein the through-hole (17) tapers.

14. A method according to claim 12, wherein the through-hole (17) tapers such that the cross-sectional area of the through-hole decreases with increasing distance from the workpiece (9, 11).

15. A method according to claim 12, wherein the through-hole (17) tapers such that the cross-sectional area of the through-hole increases with increasing distance from the workpiece (9, 11).

16. A method according to claim 1, wherein an end of the tubular portion (29) of the fastener (13) is rolled outwardly within a part-toroidal outer cavity (5) surrounding the inner cavity (17) of the setting die (1), the inner cavity comprising a through-hole of a diameter which allows a desired volume of displaced material to flow into the hole during fastener penetration of the workpiece (9, 11).

17. A method according to claim 16, wherein the through-hole (17) tapers.

18. A method according to claim 17, wherein the through-hole (17) tapers such that the cross-sectional area of the through-hole decreases with increasing distance from the workpiece (9, 11).

19. A method according to claim 17, wherein the through-hole (17) tapers such that the cross-sectional area of the through-hole increases with increasing distance from the workpiece (9, 11).

20. A method according to claim 1, wherein an additional member (33, 35) is positioned on at least one side of the workpiece (9, 11), the fastener (13) passing through a preformed aperture in the additional member.

* * * * *